United States Patent [19]

de los Santos

[11] Patent Number: 4,817,488

[45] Date of Patent: Apr. 4, 1989

[54] GUITAR SLIDE BAR APPARATUS

[76] Inventor: Federico E. de los Santos, 2068 E. Libra Dr., Tempe, Ariz. 85283

[21] Appl. No.: 207,167

[22] Filed: Jun. 15, 1988

[51] Int. Cl.[4] ..... G10D 3/00

[52] U.S. Cl. ..... 84/319

[58] Field of Search ..... 84/319

[56] References Cited

U.S. PATENT DOCUMENTS 3,638,525 2/1972 Sciurba et al. ..... 84/319

3,854,368 12/1974 Pogan ..... 84/319

*Primary Examiner*—Lawrence R. Franklin

*Attorney, Agent, or Firm*—Charles P. Padgett, Jr.

[57] ABSTRACT

A guitar slide apparatus adapted to be worn on and removed from at least one selected finger of a guitar player's fret hand. The device is dimensioned to fit on the mid-portion of the player's finger and can be worn without removal or repositioning thereon for playing steel guitar while the front portion of the finger is free to bend at the first joint and play standard guitar. The apparatus includes an arcuate band adapted to be fitted around the lower portion of any selected finger of the users hands and adjustable straps for positioning the arcuate band thereon. The width of the band is dimensioned to fit over only the mid-portion of the selected finger and leave both the first and second finger joints thereof free to move or bend in a conventional manner. It can be worn interchangeably on any selected finger of the guitar player's fret hand and can remain thereon while playing selected note, chords, or for dampening or deadening other strings of the guitar, as desired.

29 Claims, 1 Drawing Sheet

GUITAR SLIDE BAR APPARATUS

BACKGROUND OF THE INVENTION

1. Field Of The Invention

The present invention relates generally to a slide bar apparatus for use with a stringed instrument such as a standard guitar, and more particularly to a slide bar apparatus which can be quickly and easily mounted and dismounted onto any selected finger of a guitar player's fret hand and which is dimensioned to substantially cover only the middle portion of the player's selected fret finger between the first and second finger joints for contacting a plurality of guitar strings at one time for playing steel guitar on a standard guitar while simultaneously enabling the guitar player to freely bend the first and second finger joints of the selected finger for playing standard guitar separately from or simultaneously with the playing of steel guitar.

2. Field Of The Invention

One conventional slide bar apparatus of the prior art comprises an elongated cylindrical tube having a hollow interior and dimensioned to fit only one finger of the fret hand of the guitar player, usually the fourth finger of the fret hand. The length of the prior art slide bar was normally such that it covered the finger tip, the front finger portion, and the middle finger portion of the selected finger on which it was worn thereby disabling the movement of first and second finger joints to prevent the guitar player from using the selected finger for any other purpose whatsoever. This is typical of the slide bars of the prior art which must be physically removed from the selected finger in order to enable the guitar player to play standard guitar rather than steel guitar.

U.S. Pat. No. 2,466,344 which issued to F. W. Wright on Apr. 5, 1949 for a Guitar Steel shows another type of prior art guitar steel. With this type, an arcuately curved portion covers substantially the entire length of the selected finger thereby disabling the first and second finger joints and preventing the player from playing standard guitar unless the guitar steel was first removed from the finger. The guitar steel of this invention extended longitudinally along the selected finger to cover the first and second joints as well as the first, middle and rear portion of the fingers including the finger tip.

U.S. Pat. No. 3,638,525 issued to Edward Sciurba et. al. on Feb. 1, 1972 for a Finger Glide Bar. The glide bar of this patent includes a cylindrical ring portion adapted to fit around the mid-portion of a selected finger for holding purposes only, while the guitar steel or contact portion extends from the mid-portion of the finger past the first joint and under the front or first portion of the finger and the finger tip thereby preventing it from playing standard guitar while the glide bar is in that position. The glide bar of this patent is rotatable about the ring or band on the middle portion of the finger for enabling the guitar player to rotate the guitar steel from the lower or playing position to an upper or storage position above the middle and front portion of the finger and over the first finger joint. While this enables the player to move the finger tip in a somewhat restricted fashion and play standard guitar, it is only after time is wasted by rotating the device from the use position to the storage position. In use, that the device extends completely across the bottom of the finger from the mid-portion to the finger tip and totally prevents movement of the first joint or use of the front portion of the finger for playing conventional guitar while it is in the use position.

U.S. Pat. No. 3,854,368 issued to Leonard Pogan on Dec. 17, 1974 for a Finger Mountable Guitar String Contact Device. This patent shows a ring-like device comprised of a single piece of metal whose hollow interior is sized for fitting only one finger of the fret hand of a guitar finger. Again, the elongated contact surface for playing steel guitar must be rotated from the storage position to the use position for playing steel guitar and from the use position to a storage position for enabling the guitar player to use the finger for playing standard guitar. When in use position, the longitudinal contact surface covers the first joint of the finger and prevents it from being to play standard guitar notes and chords or for dampening while in that position.

U.S. Pat. Nos. 3,741,065; 3,457,822; 3,822,629; and 4,475,433 all illustrate various slide bars or capos for a stringed musical instrument. Some are extremely complex and difficult to wear while others are designed only for playing steel guitar and not for playing conventional or standard guitar at all. All must be physically removed or repositioned resulting in lost time and limiting the musical selection of the guitar player and/or his or her performance when wearing the devices. Most are extremely complex, cumbersome, and severely limit playability.

The guitar slide bar apparatuses of the prior art all suffer from the fact that they must be physically mounted and dismounted in order to switch from playing steel guitar to playing conventional guitar or they must be repositioned from a non-use or storage position to a use position for enabling the steel guitar sound to be produced. Furthermore, the slide bar apparatuses of the prior art are limited in that they are designed only for a single finger of the guitar player's fret hand, such as the fourth finger, and cannot be interchangeably used on other fingers. Still further, all severely restrict playability. This means that a guitar player cannot use the finger wearing the slide bars of the prior art to fret notes, to play chords, or to dampen the other strings of the guitar if he or she so desires. It is extremely difficult to use the other fingers while wearing a restricted slide bar and it normally totally restricts the use of the finger wearing the slide bar when the slide bar is in the use position. Still further, the mounting and dismounting of the prior art slide bar or the repositioning from a non-use or storage position to a use position takes time, thereby requiring the guitar player to stop playing and take the slide bar on and off or to reposition it. This takes time which limits the guitar player's abilities and the selection of the music he or she plays. Normally, the guitarist using the slide apparatus of the prior art can either play straight guitar or steel guitar, but not both, without switching between the two resulting in loss of time and periods of no playing.

Still another problem with the devices of the prior art resides in the fact that the inner radius which is conformed to fit the desired finger comes only in one size. Slide bars conventionally come with a relatively smaller inner radius designed specifically for the fourth finger of the fret hand, but the others are of a single size only and will fit snugly over only one finger of the fret hand. Therefore, the guitar player cannot choose which finger he wants to use it on, but must use it on the finger which happens to fit the slide bar.

The guitar slide bar or guitar steel of the present apparatus avoids substantially all of the disadvantages, problems and limitations of the prior art while providing a slide bar which can be worn on the middle portion of any selected one of the fingers of the guitar player's fret hand without restricting the ability of the selected finger to play standard guitar without the need of mounting and dismounting the device or repositioning the device from a use to a non-use position. In fact, in the preferred embodiment of the present invention, the guitar steel of the present invention can be placed on the middle portion of a selected one of the fingers of the guitar player's fret hand and can remain in that "use" position while enabling the guitar player to play standard guitar with the front finger portion and/or finger tip; steel guitar with the contact surface of the device; or both independently or simultaneously, as desired.

BRIEF SUMMARY OF THE INVENTION

It is an object of the present invention to provide a guitar slide bar which can be worn on a selected finger of the guitar player's fret hand without restricting the ability of the selected finger to fret other notes and chords and/or dampen other guitar strings, as desired.

It is another object of this invention to provide a guitar slide bar which can be quickly and easily mounted and dismounted on and from any selected fret finger of the player's hand.

It is still another object of the present invention to provide a guitar slide bar device which can be fitted interchangeably on any of the fingers of guitar player's fret hand, as desired.

It is yet another object of the present invention to provide a slide bar which can be worn to play steel guitar without limiting standard guitar playability.

It is a further object of the present invention to provide a guitar slide bar apparatus which both saves time and doesn't limit the guitar player's selection of music, abilities, or the like.

It is still a further object of the present invention to provide a guitar steel which does not have to be mounted and dismounted on and from the selected finger and which does not have to be shifted or rotated back and forth between use and non-use positions.

It is yet a further object of this invention to provide a guitar slide bar apparatus which is dimensioned to enable a guitar player to use the finger wearing the device without restrictions to play steel guitar, standard guitar and/or both simultaneously or separately, without removing or repositioning the guitar slide bar apparatus.

It is another object of this invention to provide a slide bar apparatus having a single size inner radius of the finger contact inner portion thereof which is adapted to be worn on any selected finger of the fret hand, interchangeably by a simple strap adjustment.

It is a further object of this invention to provide a guitar slide bar which is not designed solely for a single finger or for the fourth finger of the fret hand which is traditionally the weakest, but which can be worn on any selected finger without restricting the normal bending thereof for enabling the player to fret standard guitar as well as steel guitar without removal or repositioning of the device.

It is still another object of the present invention to provide a guitar slide bar apparatus which may be worn in the use position while enabling the guitar player to fret single notes or obscure chords or to dampen other guitar strings, as desired.

It is still a further object of this invention to provide a guitar slide bar which enables the first finger joint of the user's finger mounting the slide bar to bend backward as well as forward while the slide bar is mounted thereon for playing obscure chords and/or for dampening other strings of the guitar, while simultaneously playing both steel guitar and standard guitar or standard guitar only.

It is yet another object of the present invention to provide a guitar slide bar apparatus which is opened at both ends and dimensioned such that it's width is sufficient to conform to substantially the entire length of the mid-portion of the selected fret finger to enable the guitar player to play steel guitar on one or a plurality of guitar strings, simultaneously, and insufficient to in any manner restrict the bending of the selected finger joints and prevent the guitar player from playing conventional standard guitar with the same selected finger, either separately from or simultaneously with the playing of the steel guitar.

It is yet a further object of this invention to provide a guitar slide bar having an arcuate band or ring portion having a generally semi-circular cross-section and a longitudinal length which is less than that of a semicircle having the same radius.

It is another object of this invention to provide a slide bar apparatus which has sufficient weight to enable the finger on which it is worn to be exercised through practice.

It is an even further object of the present invention to provide a guitar slide bar apparatus which has a contact surface sufficient for contacting a plurality of guitar strings at a time, an inner surface contoured to fit about at least the lower portion and part of the side portion of the middle portion of any selected finger on the fret hand of the guitar player, and opposite end portions including flexible strap means for connecting said end portions together over the top of the mid-portion of the selected finger for quickly and easily mounting and dismounting the slide bar apparatus by fastening and unfastening the flexible strap means, and wherein the strap means is selectably adjustable for snugly fitting the slide bar on the middle portion of any one of the guitar player's fret fingers.

These and other objects and advantages of the present invention will become more obvious after reading the detailed description of the preferred embodiment, the claims, and the drawings which are briefly described hereinbelow.

DETAILED DESCRIPTION OF THE PREFERRED EMBODIMENT

Figure 1:
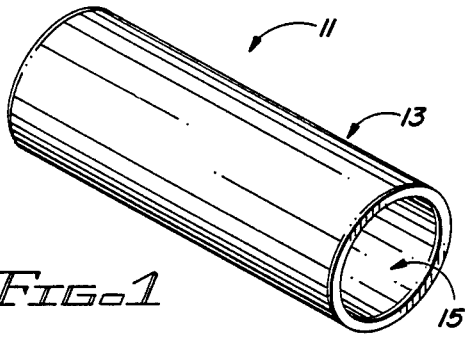
FIG. 1 is a prospective view of a conventional guitar slide bar or guitar steel of the prior art.

FIG. 1 illustrates a typical prior art guitar steel 11 which is an elongated cylindrical member 13 having a hollow interior or channel 15.

Figure 2:
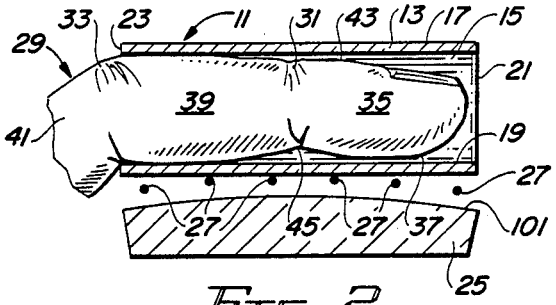
FIG. 2 is a sectional side view of the prior art guitar slide bar apparatus of FIG. 1 received over a particular finger of the guitar player's fret hand.

FIG. 2 illustrates the use of the guitar steel 11 of FIG. 1 as it is positioned upon a selected finger 29 of the guitar player's fret hand. FIG. 2 shows the elongated cylindrical member 13 as including an exterior cylindrical string contact surface 17 and an interior finger contact surface 19. The elongated cylindrical 13 further includes a first opened end or aperture 21 at one end of the hollow interior or channel 15 and a second oppose opened end or aperture 23 at the opposite end of the hollow interior or channel 15.

FIG. 2 also shows the neck portion 25 of a conventional or standard guitar. A plurality of guitar strings 27, normally six for a standard guitar, are shown as being positioned a predetermined distance above the upper surface 101 of the neck portion 25 for playing purposes.

The selected fret finger 29 is shown as including a first bending or movably finger joint 31, a second bending or movable finger joint 33, a front finger portion 35 having a finger tip portion 37, a mid-portion or middle portion 39 disposed between the first and second finger joints 31 and 33, respectively, and a rear finger portion 41. The finger 29 is also shown as including an upper or ventral side 43 and a lower or dorsal finger side 45.

In the prior art guitar steel 11 of FIGS. 1 and 2, the diameter of the hollow interior portion 15 will normally enable the guitar steel 11 to fit about one of the guitar player's fingers of his or her fret hand, thereby preventing the guitar player from being able to select the particular fret finger on which he or she would like to wear the guitar steel 11. Furthermore, it can be seen that the movement of the bending joints 31 and 33, and particularly the movement of the first joint 31, is totally restricted in movement by the interior surface 19 of the hollow interior 15 of the elongated cylindrical member 13. The front finger portion 35 and fingertip 37 are disposed within the hollow interior 15, thereby totally preventing the guitar player for being able to use the finger 29 for playing any type of standard guitar while wearing the guitar steel 11 of the prior art.

A typical prior art device such as that shown in FIGS. 1 and 2, normally includes a hollow cylindrical member having a length of approximately 6 centimeters and an interior diameter of approximately 2.5 centimeters. It will be understood that some models are thicker and heavier while others are smaller and lighter, but the overall playability restrictions remain.

Figure 3:
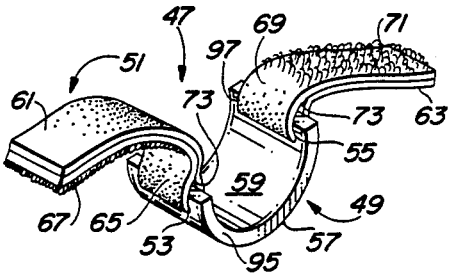
FIG. 3 is a prospective view of the guitar slide bar or guitar steel of the preferred embodiment of the present invention with the strap means in the open or unfastened position.

FIG. 3 illustrates the guitar slide or guitar steel 47 of the preferred embodiment of the present invention. In FIG. 3, the guitar slide 47 is shown as including an arcuate band or ring portion 49 and a strap means 51 for removably mounting and dismounting the arcuate band 49 to and from a selected one of the fingers of the guitar player's fret hand, as desired.

The arcuate band 49 includes a first laterally oriented elongated slot 53 in one end portion 95 thereof and a second elongated lateral slot 55 in the opposite end portion 97 thereof. The arcuate band 49 includes an outwardly curved or convex contact surface 57 and a finger-conforming portion or surface 59 on the opposite side thereof.

The strap means 51 includes a first flexible strap 61 and a second flexible strap 63. The first flexible strap 61 is shown as including an upper or top surface 65 having a predetermined length or strip of loop-type material 67 fixedly secured thereto, while the bottom or lower surface 69 of the second strap 63 includes a predetermined length or strip of hook-type material 71 fixedly secured thereto. The hook and loop strips 67 and 71 are adapted to matingly cooperate with one another in the manner of a conventional hook and loop type fastener device, as known in the prior art. Each of the first and second straps 61 and 63, respectively, include a looped end portion 73 adapted to pass through the slots 53 and 55, respectively, for fixedly securing the straps 61 and 63 to the opposite end portions 95 and 97, respectively, of the arcuate band 49.

Figure 4:
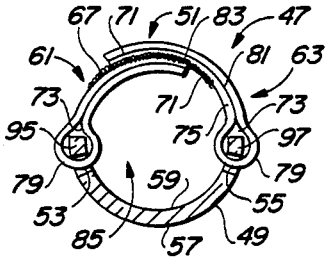
FIG. 4 is an end view of the guitar slide bar of FIG. 3 with the strap means removably fastened for a first size of fret finger diameter.

FIG. 4 shows the guitar slide bar apparatus 47 of FIG. 3 with the straps means 51 in the closed or fastened position. In FIG. 4, each of the first and second flexible straps 61 and 63 are shown as including a first strap portion 75, a second strap portion 77, and a loop portion 79 interconnecting same. Preferably, the opposing surfaces of the first strip portion 75 and the second strip portion 77 are fixedly secured together as indicated by reference numeral 81 by any conventional means such as adhesive means, heat sealing, stitching, or the like. In this manner, each of the straps 61 and 63 has one end inserted through the corresponding slots 53 and 55 and pulled therefrom to fold back over itself for forming the loop portion 79 and such that the second portion 77 which was pulled through the slot 53 or 55 overlays the first end portion 75 and is secured thereto as at seam 81 to form single, unitary, first and second flexible straps 61 and 63, respectively.

FIG. 4 also shows that the slots 53 and 55 were disposed a predetermined distance from the opposite end portion 95 and 97, respectively, of the arcuate band 49. The arcuate band 49 is shown as including an outwardly curved exterior contact surface 57 and a finger surface-conforming inner surface 59. When the strap means 51 is closed, as shown in FIG. 4, the hollow interior 85 formed between the inner surface 59 of the arcuate band 49 and the interior surfaces of the straps 61 and 63 form a hollow interior 85 which can be selectively sized or dimensioned to fit any particular finger of the guitar player's fret hand, as desired. For example, in FIG. 4, the strip of loop material 67 disposed on the top or upper surface of the first flexible strap 61 is shown as operatively engaging the hook strip 71 of the second flexible strap 63 such that they are removably fastened along the juncture of the hook and loop strips as indicated by reference numeral 83 for forming the hollow interior 85 having a first diameter.

Figure 5:
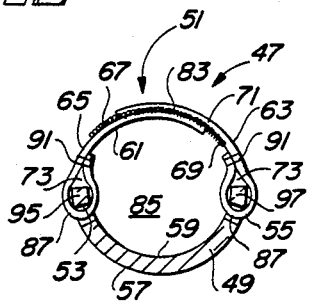
FIG. 5 is an end view of the guitar slide bar apparatus of FIGS. 3 and 4 with the strap means adjustably fastened for a different and distinct diameter of fret finger.

FIG. 5 shows the guitar slide bar apparatus of FIG. 4 with the hook and loop flexible strip ends formed over a greater surface area thereby producing a hollow interior 85' having a smaller diameter than the hollow interior 85 of the slide bar apparatus 47 of FIG. 4.

FIG. 5 also show an alternate embodiment of the strap means 51 of the present invention wherein each of the first and second straps 61 and 63, respectively, include one end portion 87 which is passed through the corresponding slots 53 and 55 and brought back over a portion of the straps 61 and 63 where they are connected thereto as by stitches or similar conventional fastening means 91. The hollow interior 73 of the loop portions 87 pass over the opposite end portions 95 and 97 of the arcuate band 49 via the slots 53 and 55, respectively. In this case, the major portion of the flexible straps 61 and 63 have a single ply rather than a double ply 75 and 77 as, shown in FIG. 4.

Figure 6:
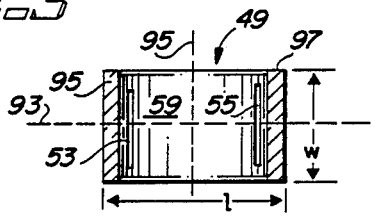
FIG. 6 is a top plan view of the arcuate band of the guitar slide bar apparatus of FIGS. 3, 4, and 5.

FIG. 6 shows a top view of the arcuate band 49 of FIGS. 3, 4 and 5. In FIG. 6, the band 49 is shown as having an interior finger surface-contacting surface 59, opposite end portions 95 and 97 through which the lateral slots 53 and 55 are disposed and an intermediate portion 99. The longitudinal axis 93 is perpendicular to the lateral axis 95 and the length "l" is measured along the longitudinal axis 93 while the width "w" is measured along the lateral axis 95.

In the preferred embodiment of the present invention, the width of the arcuate band 49 is dimensioned or sized so that it is sufficient to cover substantially the entire mid-portion 39 of the selected finger 29 for enabling the lower contact surface 57 to contact one or a selected plurality of guitar strings, simultaneously, for changing the normal vibration of the string to produce the steel guitar sound. Furthermore, the width is short enough to prevent the arcuate band 49 from interfering with the normal bending movement or motion of either the first finger joint 31 or second finger joint 33, thereby enabling the guitar player to use the selected finger mounting the arcuate band for either playing steel guitar with the contact surface 57 thereof or for enabling the front finger portion 35 and the finger tip 37 thereof to play standard guitar, including any desired notes and chords or for dampening selected strings of the guitar, as desired, either separately, or simultaneously.

Figure 7:
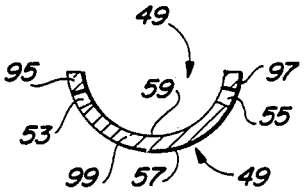
FIG. 7 is a sectional end view of the arcuate band of FIG. 6.

FIG. 7 shows an end view of the arcuate band 49 of FIG. 6 illustrating the end portions 95, 97, the slots 53, 55, respectively, and the intermediate band portion 99 including the interior finger conforming surface 59 and the exterior string contact surface 57 thereof.

Figure 8:
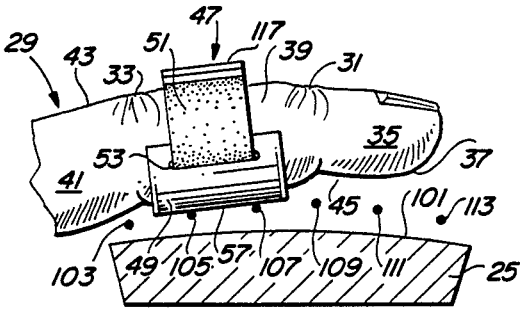
FIG. 8 is a side view of the guitar slide bar apparatus of the present invention worn or mounted upon a selected finger of the guitar player's fret hand for enabling the guitar player to play the steel guitar sound.

FIG. 8 shows the guitar slide apparatus 47 of the present invention worn or mounted on the mid-portion 39 of a selected finger 29 of the guitar player's fret hand for playing one or more of the guitar strings, either individually or simultaneously, with the contact surface 57 while leaving the first finger portion 35 and finger tip 37 free to play other strings as a standard guitar. In FIG. 8, the contact surface 57 of the arcuate band 49 is shown as contacting the strings 105 and 107 for playing steel guitar thereon while the remaining strings 103, 109, 111, and 113 are untouched. It will be seen that the first joint 31 of the finger 29 is free to move for bending the front finger portion 35 and finger tip 37 to play conventional guitar on at least the string 109, 111 and 113, either individually or together, while simultaneously retaining contact between the contact surface 57 of the arcuate band 49 and the strings 105 and 107, together or independently, by breaking the contact between the surface 57 of the arcuate band 49, and the strings 105 and 107.

Figure 9:
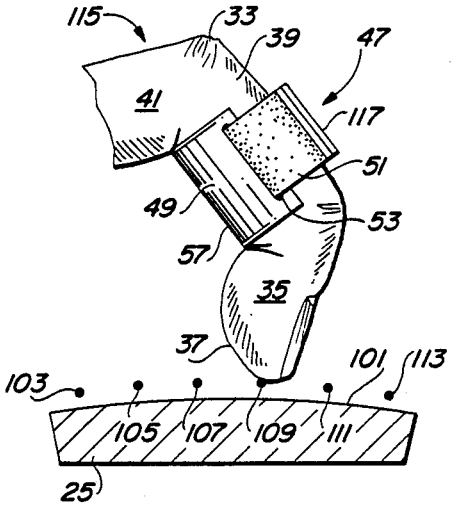
FIG. 9 is a side view of the guitar slide bar apparatus of FIG. 8 worn on a different and distinct fret finger without restricting the ability of the fingertip to play standard guitar.

FIG. 9 illustrates the guitar slide bar apparatus 47 of the present invention fitted over or mounted on the mid-portion 39 of a different finger 115 of the guitar player's fret hand. In FIGS. 8 and 9, the strap means 51 is shown as being adjustably fastened or fitted by the fastener portion 117 to snugly position the inner surface 59 of the arcuate band 49 comfortably against the dorsal surface 45 of the mid-portion 39 of the selected finger 115.

In FIG. 9, the guitar neck 25 is shown as including guitar strings 103, 105, 107, 109, 111, and 113 disposed a predetermined distance above the neck surface 101. The player has the front finger portion 35 bent at the joints 31 and 33 for contacting a single string 109 with the finger tip 37 for playing conventional guitar while simultaneously wearing the guitar slide bar apparatus 47 of the present invention in its use position.

Figure 10:
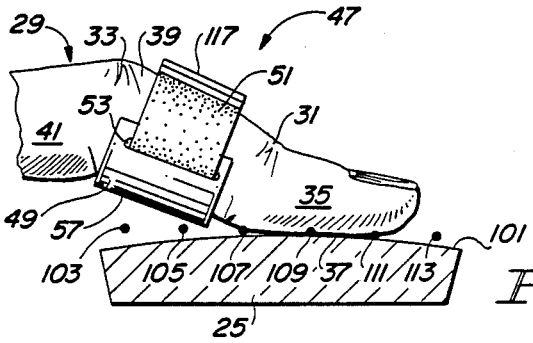
FIG. 10 is a side view of the guitar slide bar of FIGS. 8 and 9 illustrating that the guitar slide bar of the present invention can be used to play steel guitar while freeing the first finger portion and first joint to play conventional standard guitar notes and chords or for dampening selected strings, either simultaneously or individually, as desired.

Lastly, FIG. 10 shows the finger 29 mounting the guitar slide apparatus 47 of the present invention with the finger bending the second joint 33 downward and the first joint 31 backward or upward to enable the player to play obscure chords or dampen some of the strings 107, 109, and 111 as desired, while wearing the arcuate band 49 in its use position. Similarly, FIG. 10 is meant to illustrate that one portion of the contact surface 57 can be brought down upon the string 105 or the strings 103 and 105 for producing the steel guitar sound simultaneously with the chord or note being played by the first finger portion 35.

In the preferred embodiment of the present invention, the arcuate band 49 includes a metal material such as steel or brass or a material such as glass. Furthermore, the flexible straps 61 and 63 may be manufactured from any suitable conventional material such as leather, nylon, or any number of suitable natural or synthetic cloth-like materials or plastics. The hook and loop fastener means are also conventional and typically sold under the Registered Trademark Velcro®. Furthermore, the width of the arcuate band 49 is approximately 2 centimeters and the end portions and slots are filed smooth to prevent wear and tear on the straps. It will be noted that the guitar slide bar apparatus 47 of the present invention can be selectively removed from and mounted on any other fret finger of the guitar player's fret hand, as desired, by a simple adjustment or positioning of the first and second straps 61 and 63, and that the guitar player has full use of the finger mounting the slide bar apparatus 47 for playing conventional guitar, including playing individual notes, chords, and/or for selectively deadening or dampening one or more of the strings, as desired. Furthermore, the construction of the guitar steel 47 of the present invention has its width dimensioned so that it is long enough to cover substantially the entire length of the lower surface of the mid-portion of the user's selected finger so that it does not interfere with the front finger portion and its fingertip being able to play conventional guitar while enabling the guitar player to stop playing conventional guitar and play steel guitar with the contact surface of the band or to play both steel guitar and standard guitar, simultaneously, if desired.

It will be obvious to those skilled in the art that various modifications, alterations, substitutions, changes, and revisions can be made in the guitar slide bar apparatus or guitar steel of the present invention without departing from the spirit and scope of the invention which is limited only by the appended claims.

I claim:

1. A guitar slide apparatus adapted to be worn on and removed from at least one selected finger of a guitar player's fret hand, said at least one selected finger including a first finger joint, a finger tip portion forward of said first finger joint, a second finger joint, a finger mid-portion disposed between said first and second finger joints, and a rear finger portion on the opposite side of said second finger joint, said guitar slide apparatus comprising:

a partially semicircular arcuate band means having a lateral length sized to fit over said finger mid-portion without encumbering the normal bending movement of said first and second finger joints, said arcuate band means having a convexly curved exterior surface means for contacting at least one selected guitar string and altering its normal vibration for producing the steel guitar sound, an opposite concave surface means for conforming to the curve of at least the bottom of said finger mid-portion, and a pair of opposite end portions; and means operably coupled to said opposite pair of end portions of said band means for quickly and easily removably securing and unsecuring said arcuate band to the finger mid-portion of said at least one selected finger.

2. The guitar slide apparatus of claim 1 wherein said partially semicircular, arcuate band means includes at least one of glass, brass, and steel.

3. The guitar steel apparatus of claim 2 wherein said partially semicircular, arcuate band means includes glass.

4. The guitar steel apparatus of claim 1 wherein said partially semicircular, arcuate band means includes a metal material.

5. The guitar steel apparatus of claim 4 wherein said metal material includes brass.

6. The guitar steel apparatus of claim 4 wherein said metal material includes steel.

7. The guitar slide apparatus of claim 1 wherein the longitudinal length of said band means measured perpendicular to the axis of said selected one of said fingers is less than that of a semicircle of the same radius.

8. The guitar slide apparatus of claim 1 wherein each of said opposite end portions of said band means includes a relatively narrow lateral slot spaced a predetermined distance from the distal ends of said band means, the axis of said lateral slots being substantially perpendicular to the longitudinal axis of said band means and parallel to the longitudinal axis of said selected one of said fingers.

9. The guitar slide apparatus of claim 8 wherein said means for removably securing and unsecuring said band means to said finger mid-portion includes a strap means having a length dimensioned for removably connecting said opposite pair of lateral slots together over the top of said finger mid-portion of said at least one selected finger.

10. The guitar slide apparatus of claim 9 wherein said strap eans includes a first strap having one end portion operatively secured through said first slot to one end portion of said band means and an opposite end including one of a male hook and female loop fastener material operatively disposed on the lower surface thereof, a second strap having one end operatively secured through said second slot to the opposite end of said band means, and an opposite end having the opposite one of said male hook and female loop fastener material operatively disposed on the upper surface thereof for removably interlocking to said opposite one of said male hook and female loop fastener materials for holding said band means securely against the lower surface of said finger mid-portion, said male hook and female loop fastener material being responsive to the manual application of separation force applied thereto for separating said first and second straps and enabling said guitar player to quickly and easily remove said band means from said finger mid-portion.

11. The guitar slide apparatus of claim 10 wherein the width of said strap is less than the width of said arcuate band means.

12. The guitar slide apparatus of claim 10 wherein the lateral width of said band means taken along the longitudinal axis of said selected finger of said fret hand is sufficient for contacting a plurality of guitar strings at one time.

13. The guitar slide apparatus of claim 10 wheriin the width of said band means is sufficient for contacting a plurality of guitar strings at one time and short enough to permit the guitar player to freely bend at least said first finger joint of said selected finger for enabling the finger tip of said selected finger to simultaneously play notes and chords and for dampening a selected number of said plurality of guitar strings, simultaneously.

14. The guitar slide apparatus of claim 10 wherein said straps may be quickly and easily separated and attached together for removing said band means from said selected finger of the guitar player's fret hand and remounting same on another different and distinct finger of the guitar player's fret hand.

15. The guitar slide apparatus of claim 10 wherein the width of said band means is greater than the width of said strap means and both lengths are sufficiently small to enable that band means and said strap means to be mounted on the finger mid-portion while simultaneously allowing at least the first and second joints thereof to bend freely for playing straight guitar.

16. The guitar slide apparatus of claim 10 wherein the dimension of said band means and said strap means enable the guitar players selected finger on which it is mounted to play both steel guitar and straight guitar simultaneously.

17. The guitar slide apparatus of claim 1 wherein said concave surface of said band means is dimensioned to fit any one of the four fingers of the guitar player's fret hand.

18. The guitar slide apparatus of claim 17 wherein the combined weight of said band means and said strap means is sufficient to exercise said selected finger for strengthening same through practice.

19. A slide apparatus for altering the vibrations of at least one selected string of a guitar or similar stringed instrument to produce a steel guitar sound comprising:

an arcuate band having an outwardly curved surface for contacting said at least one selected guitar string, an inner surface for conforming to the shape of the lower part of the middle joint of any selected one of the guitar player's fret fingers;

means for removably mounting and dismounting said band on and from said middle joint;

said band having a sufficient width measured laterally along the longitudinal axis of said selected finger for contacting at least one of a plurality of selected guitar stings, said width being sufficiently short for substantially extending the entire length of said middle joint without contacting any of the guitar players first and second bending joints of said selected finger for enabling the guitar player to use the first finger joint and the finger tip thereof for selectively playing notes and chords and for selectively dampening a plurality of guitar strings, as desired, at least one of separate from and simultaneously with said outwardly curved contact surface of said arcuate band for producing said steel guitar sound.

20. The slide apparatus of claim 19 wherein said arcuate band includes at least one of glass, brass and steel.

21. The slide apparatus of claim 19 wherein said arcuate band includes opposite end portions having laterally oriented slots operatively disposed therethrough and positioned adjacent the ends thereof and wherein said mounting and dismounting means includes strap means having opposite ends fixedly secured within said slots for removably mounting and dismounting said band on said middle finger joint.

22. The slide apparatus of claim 21 wherein said strap means includes first and second flexible straps, each of said straps having one end portion fixedly secured to the opposite ends of said band through said slots and wherein the opposite end portions of said straps including hook and loop fastener means for removably connecting and disconnecting said straps to removably mount and dismount said band to the middle joint of said selected finger.

23. The slide apparatus of claim 22 wherein the width of said band and the width of said strap means is selected to enable the guitar player to simultaneously play steel guitar with said band and regular guitar with the first joint of said selected finger.

24. A finger guitar steel for altering the normal vibration of at least a selected one of the guitar strings of a straight guitar for producing a steel guitar sound comprising:

an arcuate member having a substantially semicircular cross-section, said member having one contact surface adapted for contacting at least a selected one of said plurality of guitar strings to produce a steel guitar sound and an opposite surface adapted to conform to the dorsal side of the middle portion of a selected one of the guitar player's fret fingers, said arcuate member also including opposite end portions;

flexible strap means adapted to snugly fit over the opposite ventral surface portion of said middle portion of a selected one of the guitar player's fret fingers for removably mounting and dismounting said arcuate member to the dorsal surface of said middle portion of said selected finger;

said flexible strap means being selectively separable and connectable for selectively mounting and dismounting said member from and onto said middle portion of said selected one of the guitar player's fret fingers for non-use and use purposes, respectfully;

said arcuate member and said strap means forming a generally cylindrical substantially hollow channel therebetween for fitting snugly about said middle portion of selected one of the guitar player's fret fingers and being opened at both ends to enable a free bending movement of the first and second joints at the opposite ends thereof; and the width of said arcuate member being dimensioned for covering substantially the entire length of the middle portion of said selected finger without in any way restricting the bending of said selected fingers first and second joints at opposite ends of the arcuate member while enabling said dimensioned arcuate member to contact a plurality of guitar strings simultaneously, as desired, and for enabling said guitar player to use both the annular member on the middle portion of said at least one selected finger to play steel guitar while simultaneously enabling the guitar player to bend at least the first joint of said selected finger for playing substantially all things possible with a straight guitar.

25. The finger guitar steel of claim 24 wherein the width of said arcuate member measured along the longitudinal axis of said selected finger and the width of said strap means is less than the length of the mid-portion of said selected finger to avoid interfering with the free bending motion of at least the first joint of said finger to enable the guitar player to use the first portion of said finger for playing straight guitar while wearing said arcuate member mounted to said mid-portion of said same finger.

26. The finger guitar steel of claim 24 wherein said arcuate member includes an arcuatly curved band having an outwardly curved lower surface adapted to contact selected guitar strings and an inner surface adapted to conform to the shape of the mid-portion of the wearer's finger, said arcuate member also including a pair of opposite end portions.

27. Finger guitar steel of claim 26 wherein said opposite surfaces of said arcuate member and the opposite end portions thereof having a length less than the length of a semicircle of the same radius.

28. The finger guitar steel of claim 26 wherein the opposite end portions of said arcuately curved band include a pair of lateral slots and wherein said strap means includes first and second flexible straps each having one end portion operatively secured to the opposite end portions of said arcuate curved band through said slot disposed therein and an opposite end portion provided with fastener means for connecting said first and second straps together for mounting and dismounting said arcuately curved band to and from the mid-portion of a selected one of the guitar player's fret fingers.

29. The finger guitar steel of claim 28 wherein a lower surface of one of said first and second flexible straps are provided with a hook fastener strip and the opposite end portion of said second straps is provided with a corresponding loop fastener strip operatively disposed thereon for matingly connecting and unconnecting the opposite ends of said first and second flexible straps for selectively mounting and dismounting said arcuately curved band from said mid-portion of selected one of the guitar player's fret fingers for use and non-use purposes, respectfully.

* * * * *